US005222641A

United States Patent [19]

Medeiros, Jr.

[11] Patent Number: 5,222,641

[45] Date of Patent: Jun. 29, 1993

[54] CARRIER DEVICE FOR INFANTS

[76] Inventor: Edmund E. Medeiros, Jr., 41-846 Laumilo St., Waimanalo, Hi. 96795

[21] Appl. No.: 896,774

[22] Filed: Jun. 10, 1992

[51] Int. Cl.[5] ..... A61G 1/00

[52] U.S. Cl. ..... 224/161; 224/265; 224/270; 297/244; 297/255

[58] Field of Search ..... 224/158, 159, 160, 161, 224/157, 155, 201, 265, 266, 270; 297/255, 254, 399, 244

[56] References Cited

U.S. PATENT DOCUMENTS

| | | | |
|---|---|---|---|
| D. 204,190 | 3/1966 | Levy | 297/254 |
| 255,180 | 6/1980 | Raz . | |
| 294,429 | 3/1988 | Vasquez . | |
| 1,039,009 | 9/1912 | Averill . | |
| 2,712,404 | 7/1955 | Miller | 224/201 |
| 2,854,060 | 9/1958 | Welsh | 297/255 |
| 3,009,613 | 11/1961 | Noland | 224/265 |
| 3,881,644 | 5/1975 | Demaline | 224/161 |
| 4,271,998 | 6/1981 | Ruggiano . | |
| 4,469,259 | 9/1984 | Krich . | |
| 4,941,604 | 7/1990 | Nagareda . | |

FOREIGN PATENT DOCUMENTS 678225 8/1952 United Kingdom .

*Primary Examiner*—Linda J. Sholl

*Attorney, Agent, or Firm*—Shlesinger, Arkwright & Garvey

[57] ABSTRACT

The present invention relates to an upfront carrier device for infants or other items which is adapted to be secured to a wearers upper body and comprises first and second rigid, inverted J-shaped members, each of the J-shaped members comprises a downwardly extending short leg portion and a downwardly extending long leg portion interconnected by a top portion which is positioned central over each shoulder of the wearer. A cross-bar interconnection member including first and second ends extends between and is connected to at its first and second ends to the first and second J-shaped member long leg portions to position the long leg portions parallel to each other. The J-shaped member long leg portions are pivotally attached to the cross-bar interconnection member to allow about 90° inward axial rotation of the long leg portions and cause the short leg portions to swing into a folded position. A generally U-shaped seat portion having a front, first side, second side, first end and second end is provided. The seat portion first end is pivotally connected to the first J-shaped member long leg portion and the seat portion second end is pivotally connected to the second J-shaped member long leg portion to allow the seat portion to swing upwardly from a substantially horizontal position and against the long leg portion into a folded position. A stop means on the cross-bar interconnection member is provided to lock the seat portion into a less than 90° horizontal position from the long leg portions.

8 Claims, 2 Drawing Sheets

CARRIER DEVICE FOR INFANTS

FIELD OF THE INVENTION

The present invention generally relates to infant carriers, and more specifically those carriers worn on the front of a wearers body.

BACKGROUND OF THE INVENTION

Devices for carrying and transporting infants which are mounted upon the shoulders of the user are well known in the prior art. For example, U.S. Pat. No. 4,271,998 (Ruggiano) discloses an infant carrier having a pouch which is used to encompass the infants torso and thighs. That device includes flexible shoulder straps for the wearer which secure the infant to the front of the wearers body. Similar prior art infant carriers which use flexible straps to secure the infant to the wearers body include U.S. Pat. No. 4,469,259 (Krich et al.) and U.S. Pat. No. 4,941,604 (Nagareda).

Although the above noted carrier devices provide the convenience of positioning the child against the front of a wearers body, they all possess shortcomings. Because the prior art devices lack internal frame supports they contain an inordinate suspension which tend to stress the wearer about his shoulders and waist. As a result, the devices require constant adjustment when the child shifts and moves within his seat.

In addition, the above noted prior art carrier devices require a wearer to manipulate a number of straps and connectors when putting on and taking off the device. Further, the prior art carriers collapse around the infant during use thereby pressing the infants body against the wearer and contributing to excessive heat and discomfort for both the infant and the wearer. Lastly, the above noted prior art carriers are not easily convertible to carry loads other than infants.

A need has thus existed within the art for an infant carrier which is comfortable for both the wearer and the infant, may be quickly put on and taken off by the wearer and has the capability of allowing the infant to be positioned in front of the wearer facing forward.

OBJECTS AND SUMMARY OF THE INVENTION

It is therefore an object of the present invention to provide a new and improved carrier device for an infant or child capable of carrying the infant on the front and facing outward from the wearers body with increased comfort for both the wearer and the infant.

It is an additional object of the present invention to provide a lightweight and comfortable infant carrier which includes an internal frame to provide increased support yet remains capable of being folded into a flat and compact unit for storage or travel.

Yet another object of the present invention is to provide a carrier device for an infant which requires no straps or buckles to be attached to the wearer thereby increasing freedom of movement for the wearer.

A still further object of the present invention is to provide an upfront infant carrier which can be put on and taken off by the wearer with a minimum of effort and as quickly as possible.

A still further object of the present invention is to provide a carrier device for an infant which positions the infant in front of the wearer so as to shield the infant from potential harm or falling debris.

Yet another object of the present invention is to provide a carrier device for an infant which is weather resistent, foldable and contains a durable internal frame structure which is padded for comfort.

Another object of the present invention is to provide a carrier device for an infant which reduces unwanted motion to the infant while the carrier is in use.

A still further object of the present invention is to provide a carrier device for an infant where movement of the child within the seat portion of the carrier will not affect tensioning of the infants shoulder harness and lap strap.

Another object of the present invention is to provide a carrier device for an infant which is more comfortable for the wearer and requires no adjustments or straps to secure the device to the wearers body.

A still further object of the present invention is to provide a carrier device for an infant which is readily convertible from carrying an infant or small child to carrying items such as equipment or supplies.

Still another object of the present invention is to provide a lightweight, comfortable carrier device for an infant or child which safely supports the infant therein and greatly reduces the burden on the carrier person.

It is another object of the present invention to provide a new and improved baby carrier capable of carrying a baby facing either inward or outward when positioned on the front of the wearer, with equal comfort and favorable results.

The present invention relates to a carrier device for infants or other items which is adapted to be secured to a wearers upper body and comprises first and second rigid, inverted J-shaped members, each of the J-shaped members comprising a downwardly extending short leg portion and a downwardly extending long leg portion interconnected by a top portion which is positioned central over each shoulder of the wearer. A cross-bar interconnection member including first and second ends is also provided and extends between and is connected to at its first and second ends thereof to the first and second J-shaped member long leg portions to position the long leg portions parallel to each other. The J-shaped member long leg portions are pivotally attached to the cross-bar interconnection member thereby allowing about 90° inward axial rotation of the long leg portions so as to cause the short leg portions to swing into a folded position. A generally U-shaped seat portion having a front, first side, second side, first end and second end is provided and the seat portion first end is pivotally connected at the first J-shaped long leg portion. The seat portion second end is pivotally connected to the second J-shaped member long leg portion to allow the seat portion to swing upwardly from a substantially horizontal position and against the long leg portions into a folded position. A first stop means is provided on the cross-bar interconnection member to lock the seat position into a less than 90° horizontal position from the long leg portions. First closed webbing means is secured to the long leg portion and extends therebetween to form a back rest. Second closed webbing means are provided and secured to the U-shaped seat portion and the interconnection member and extend therebetween to provide a seat.

These and other objects of the present invention will become more apparent from the detailed subscription to follow, taken together with the accompanying drawings.

PREFERRED EMBODIMENT OF THE PRESENT INVENTION

Figure 1:
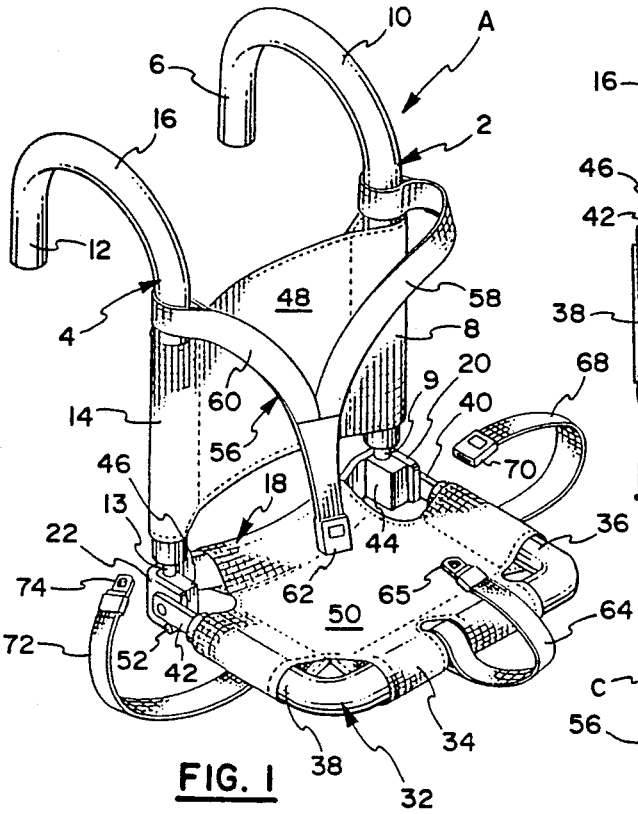
FIG. 1 is a perspective view of the front of the carrier device according to the present invention including the shoulder harness and lap strap.

Referring now to FIG. 1, the present invention is shown generally at A and comprises a first rigid, inverted J-shaped member 2 and a second rigid, inverted J-shaped member 4. The first inverted J-shaped member 2 comprises a first downwardly extending short leg portion 6 and a first downwardly extending long leg portion 8 interconnected thereto by arcuate top portion 10. In a similar manner, the second rigid inverted J-shaped member 4 comprises a second downwardly extending short leg 12 and a second downwardly extending long leg 14 which is interconnected by a second curved or arcuate-shaped top portion 16. The long legs 8 and 14 are provided with end portions 9 and 13 respectively which are pivotally connected to hinge swivel blocks 44 and 46 respectively.

Figure 2:
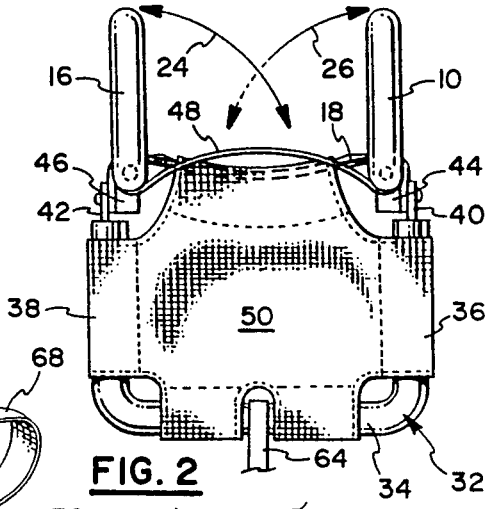
FIG. 2 is a top plan view of the carrier device according to the present invention with portions of the shoulder harness broken away and including arrows indicating the 90° inward axial rotation of the J-shaped members.
Figure 4:
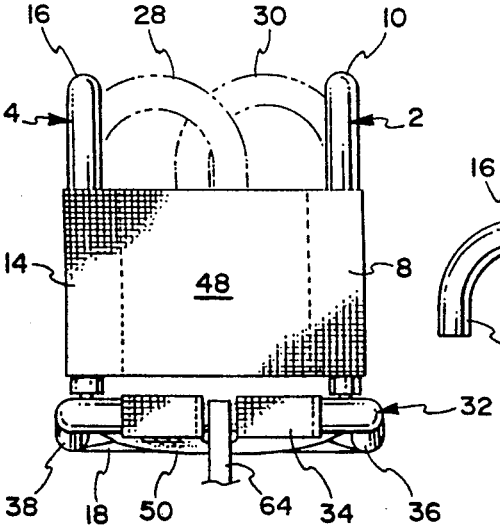
FIG. 4 is a front elevational view of the device according to the present invention and illustrating the position of the J-shaped members when in a folded position as shown in phantom lines.

A cross-bar interconnection member 18 having a first end 20 and second end 22 extends at right angles therefrom and is generally positioned between the respective ends of the J-shaped member long leg portions 8 and 14. The first end 20 and second end 22 are rigidly connected to hinge swivel blocks 44 and 46 respectively. As best shown in FIGS. 2 and 4, the pivotal connection between the long leg end portions 9 and 13 and the hinge swivel blocks 44 and 46 provides about 90° inward axial rotation of each of the long leg portions 8 and 14. This rotation is best shown by arrows 24 and 26 of FIG. 2 as well as by phantom lines 28 and 30 of FIG. 4.

Referring now to FIGS. 1 and 2, a generally U-shaped seat portion 32 is shown comprising a front 34, first side 36, second side 38, first end 40 and second end 42. Both the first and second J-shaped members 2 and 4 as well as the U-shaped seat portion 32 are shown having a tubular configuration. In a preferred embodiment these internal frame members are constructed from lightweight alloy such as aluminum which provides sufficient strength at a minimum of weight. It is however within the scope of the present invention to construct the internal frame members from materials other than aluminum or in configurations which are other than tubular in cross-section. For example, the internal frame members may be constructed from rigid plastic or in a flat cross-sectional shape. Additionally, it is within the scope of the present invention to encase the internal frame members with a foamed polyurethane or other cushioning material to provide additional wearer comfort.

Referring again to FIG. 1, the first end 40 of the U-shaped seat portion 32 is pivotally connected to the cross-bar interconnection member first end 20 at hinge swivel block 44. Similarly, the second end 42 of U-shaped seat portion 32 is pivotally attached at a second hinge swivel back 46 to cross-bar interconnection member second end 22. A stop means 52 is also shown extending from the cross-bar interconnection member second end 22 and forms an abutment against which the U-shaped seat portion 32 will rest and as further explained below. An identical stop means 54 is also provided and extends from cross-bar interconnection member first end 20 (not shown) in a similar manner.

A back rest 48 of closed webbing is shown connected to and extending between the first inverted J-shaped member long leg portion 8 and the second inverted J-shaped member long leg portion 14. Similarly, a seat 50 of closed webbing is shown attached to and extending between the U-shaped seat portion front 34, first side 36, second side 38 and cross-bar interconnection member 18. Both the back rest 48 and the seat 50 are shown in the drawings as closed webbing which is sewn in a secured fashion to the internal frame portions. Applicants have found that closed webbing fabric of a synthetic or natural material is preferred since such material is breathable and provides increased comfort for both the wearer of the device and the infant or child seated within the carrier. It is within the scope of the present invention to make the back rest 48 and seat 50 of materials other than closed webbing so long as such material has sufficient strength for support and retains durability over time.

As best shown in FIG. 1, a shoulder strap assembly 56 is depicted as comprising a first shoulder strap 58 and second shoulder strap 60 each of which is attached at one end thereof to a respective first inverted J-shaped member 2 and second inverted J-shaped member 4. The first and second shoulder straps 58 and 60 generally terminate at female fastener 62. A crotch strap 64 is shown attached at one end thereof to the U-shaped seat portion front 34 and provided at an opposite end thereof with a male fastener 65 which connects in a releasably locking relationship to fastener 62. A first thigh strap 68 is attached at one end thereof to the first side 36 of the U-shaped seat portion 32 and is further provided at the second end thereof with a female fastener 70 of similar construction to female fastener 62. Similarly, a second thigh strap 72 is attached at one end thereof to the second side 38 of U-shaped seat portion 32 and is further provided at a second end thereof with a male fastener 64 adapted to be releasably securable to the female fastener 70.

Both the shoulder strap assembly 56 and the thigh straps 68 and 72 are constructed from materials the same or similar to back rest 48 and seat 50. Although such closed webbing materials are preferred, it is within the scope of the present invention to provide any of a variety of materials which provide sufficient strength to securely seat an infant within the carrier device A. Similarly, the various male and female fasteners may be designed as clips, buckles or other type connectors which are well known in the art of seat belt type devices.

Figure 3:
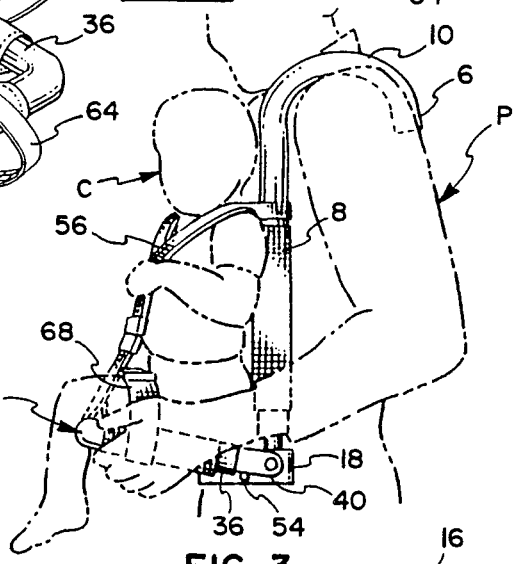
FIG. 3 is a side elevational view showing the baby carrier of the present invention mounted upon a wearer shown in phantom lines and supporting a small child, facing forward and also shown in phantom lines.

Turning now to FIG. 3, the device according to the present invention is shown positioned on a wearer P with an infant or child C supported therein and as shown by phantom lines. The wearer or carrier person P is shown in phantom lines with the carrier device A being supported on the wearers' P shoulders. When positioned in this manner, the back rest 48 of the carrier device A is positioned in front of the chest of the wearer P and the seat 50 extends forwardly therefrom . A child C may sit as shown in FIG. 3 facing forward and in the same direction as the wearer P. In use, the shoulder strap assembly 56 extends over the child's C shoulder and is connected to the crotch strap 64 which extends between the legs of the child C. Thigh strap 68 and thigh strap 72 are also interconnected to secure the child C in a sitting position on seat 50.

It is also within the scope of the present invention to arrange an infant or child within the carrier device so that he faces the wearer P (not shown). In that embodiment, the shoulder strap assembly 56 extends over the child's back and the thigh strap would be connected in the manner noted above. Each of the childs' legs would then extend along each of the sides 36 and 28 of the U-shaped seat portion 32. Whether the child's seat faces outwardly or inwardly, he is securely fastened to the carrier device A with a minimum stress since the rigid internal frame members provide the bulk of the support.

Figure 5:
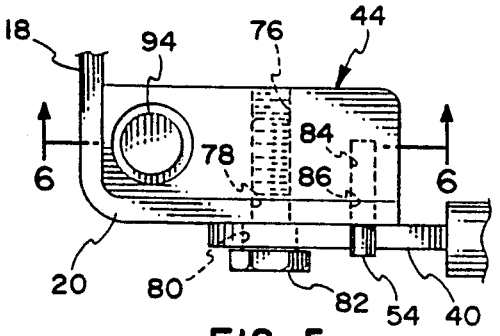
FIG. 5 is an enlarged bottom plan fragmentary view illustrating the hinge swivel block according to the present invention with portions of the U-shaped seat portion first end and cross-bar interconnection member broken away.
Figure 6:
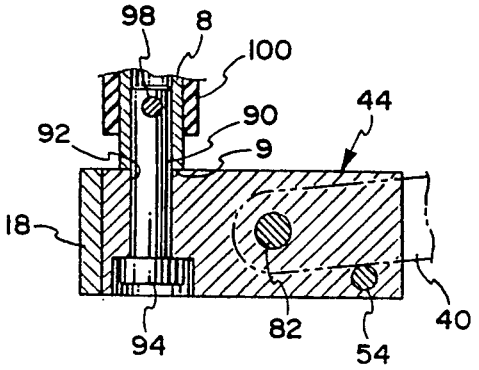
FIG. 6 is a cross-sectional side view of the device shown in FIG. 5 and taken along lines 6—6 and illustrating the J-shaped long leg portion with portions broken away therefrom and showing the U-shaped seat portion first end in phantom lines.

Turning now to FIGS. 5 and 6, a hinge swivel block 44 is shown in greater detail. FIG. 5 shows the cross-bar interconnection member 18 having a first end 20 set at a 90° right angle therefrom. The hinge swivel block 44 is fastened to fit against the cross-bar interconnection member first end 20. A threaded bore 76 extends through the hinge swivel block 44. A second bore or passageway 78 extends through the cross-bar interconnection member first end 20 and is coaxially aligned with the threaded bore 76. A third bore 80 extends through the first end 40 of U-shaped seat portion 32 and is coaxially aligned with the second bore 78 and threaded bore 76. A self locking bolt 82 extends through the second bore 78 and third bore 80 and is threadedly connected to the threaded bore 76 within the hinge swivel block 44 thereby pivotally connecting the U-shaped seat portion 32 to the J-shaped member 2. The other end 42 of seat portion 32 is pivotally connected to hinge swivel block 46 in a similar manner.

A seat support pin or stop means 54 is shown extending laterally from the hinge swivel block 44 and in the same direction as self locking bolt 82. The seat support pin 54 interfits a bore or passageway 84 extending within the hinge swivel block 44. A portion of the seat support pin 54 extends through a bore 86 of first end 20 which is coaxially aligned with bore 84 of hinge swivel block 44. The seat support pin thus extends within both bores 84 and 86 and projects laterally from hinge swivel block 44 forming an abutment against which the U-shaped seat portion first end 40 will rest when the seat 32 is opened.

Figure 7A:
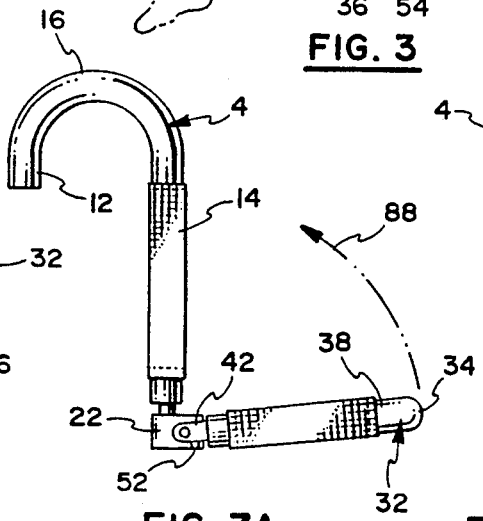
FIG. 7A is a side elevational view of the infant carrier according to the present invention without the shoulder harness and lap straps and including an arrow indicating the direction of movement into a folded position of the U-shaped seat portion.
Figure 7B:
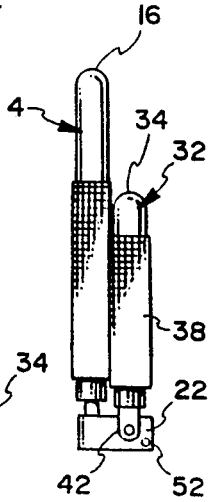
FIG. 7B is a side elevational view of the carrier device according to the present invention when in a completely folded position.
Figure 8:
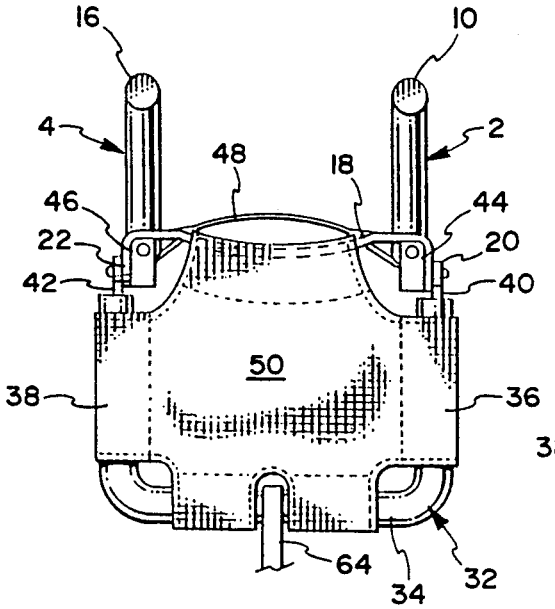
FIG. 8 is a bottom plan view of the device according to the present invention.
Figure 9:
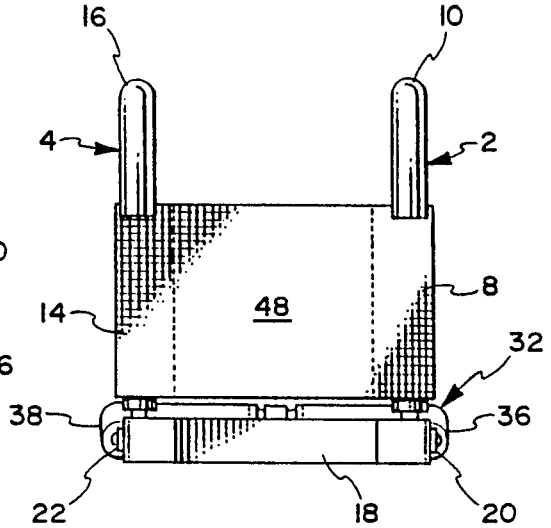
FIG. 9 is a rear elevational view of the device according to the present invention.

Because of the positioning of the seat support pin 54 within the hinge swivel block 44 the seat is disposed at a slightly less than 90° angle with respect to the downwardly extending long leg portion 8 and as best shown in FIGS. 3 and 7A. This slightly less than 90° angle provides increased comfort for the child C who is seated within the carrier device. When the carrier device A is not in use or is being transported, the U-shaped seat portion 32 will fold into an upward position as indicated by arrow 88 of FIG. 7A and into a folded position as shown by FIG. 7B where the U-shaped seat portion 32 rests against the inverted J-shaped member 4. The U-shaped seat portion 32 will pivot about the self locking bolt 82. Hinge swivel block 46 has a construction similar to hinge swivel block 44 and operates in the same manner to allow the entire U-shaped seat portion 32 to pivot from an open position in FIG. 7A to a folded or closed position in 7B.

Returning again to FIGS. 5 and 6, the hinge swivel block 44 is shown as including a swivel pin 90 which is axially rotatable within a pin bore 92. A swivel pin head 94 is countersunk into the surface of the hinge swivel block 44 at one side thereof. The opposite end of swivel pin 90 extends beyond the bore 92 and the exterior surface of hinge swivel block 44. Downwardly extending long leg portion 8 is provided with a tubular end portion 9 which interfits over the end of swivel pin 90 and is secured by lateral retaining pin 98. Also shown is padding or cushioning 100 which encases the surface of the long leg portion 8.

The mounting of the long leg portion 8 of J-shaped member 2 onto the end of the swivel pin 90 allows about 90° inward axial rotation of the long leg portion thereby causing the respective short leg portion to swing into a folded position as shown by arrows 24 and 26 of FIG. 2 and phantom lines 28 and 30 of FIG. 4. Thus, the carrier device according to the present invention is capable of folding into a fully collapsed position by axially rotating each of the J-shaped members 2 and 4 inwardly while also raising the U-shaped seat portion 32 upwardly against both long leg portions 8 and 14 and as best shown by FIG. 7B.

Figure 10:
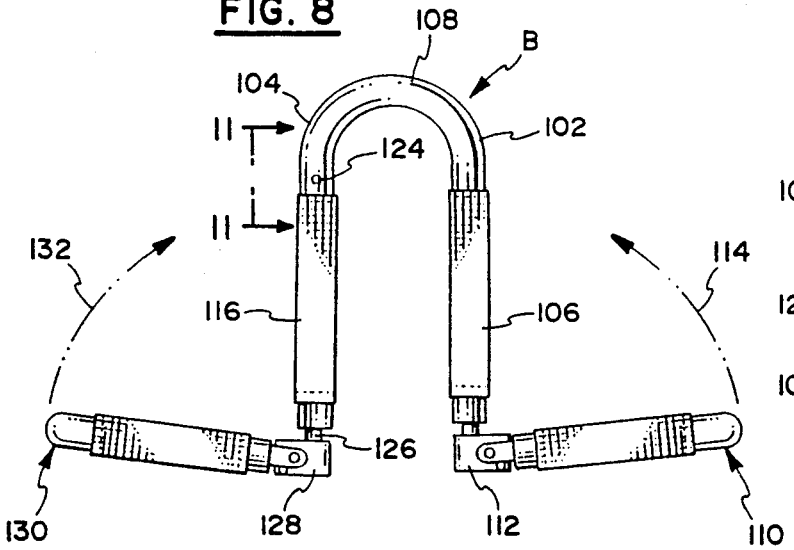
FIG. 10 is a side elevational view of the device according to the present invention and including a extension member shown supporting a second U-shaped seat portion and including arrows indicating direction of folding of the first and second U-shaped seat portions.
Figure 11:
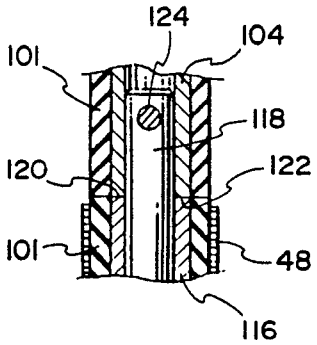
FIG. 11 is an enlarged cross-sectional view taken along lines 11—11 of FIG. 10 and illustrating the connector for the extension member.

The device according to the present may also be modified to include an additional seat or support shelf and as best shown in FIGS. 10 and 11. The modified carrier device B is shown as initially including all of the elements of the device A shown in FIGS. 1 through 9. A first rigid inverted J-shaped member 102 is shown including a first downwardly extending short leg portion 104, a first downwardly extending long leg portion 106 and a first top portion 108. Surface padding or cushioning 101 is also provided as noted above. Also shown is a U-shaped seat portion 110 which pivots about a hinge swivel block 112 from a less than 90° angle open position to a folded position against the long leg portion 106 and as shown by arrow 114. The construction of all the above elements is similar to that shown and described in FIGS. 1–9. A first extension member 116 is additionally provided and extends from short leg portion 104. First extension member 116 extends parallel to and is generally the same length as long leg portion 106. The first extension member 116 is virtually identical in construction to long leg portion 106 but for an added connection pin 118 as shown in FIG. 11. One end of connection pin 118 interfits within a tubular opening 122 positioned at the end of short leg 104. A second end of connection pin 118 interfits at first end 120 of first extension member 116 to secure the short leg portion 104 to extension member 118. The connection between pin 118 and extension member 116 is of a rigid construction and will not separate under normal use. A locking pin 124 is provided and extends laterally through the surface of the short leg 104 into pin 118 so as to interlock the entire assembly forming a rigid extension. Also provided but not shown is a second J-shaped member with extension connected by a hinge swivel block disposed parallel to the first J-shaped member 102 and spaced therefrom.

As best shown in FIG. 10, first extension member 116 includes a second end 126 which is adapted to interfit within a hinge swivel block 128 in a fixed manner. Pivotally attached to the hinge swivel block 128 is a second U-shaped seat portion or supporting surface 130 substantially similar to seat portion 110 and capable of pivoting from a slightly less than 90° angle to a position against the first extension member 116 and as shown by arrow 132.

In operation, a user (not shown) will shoulder the modified carrier device B in a similar manner to that shown in FIG. 3 but will now be provided with a seat portion extending forwardly and a seat portion extending rearwardly from the users upper torso. Thus, when the modified carrier device B is equipped with a shoulder strap assembly on either the first extension member 116 and/or J-shaped member long leg portion 106 it is adaptable to carry a second child. Alternatively, no shoulder strap assembly will be provided and the seat portions 110 and 130 may function as foldable shelves or support surfaces for equipment or the like.

While the invention has been disclosed as having a preferred design, it is understood that it is capable of further modifications, uses and/or adaptations of the invention following in general the principle of the invention and including such departures from the present disclosure as come within known or customary practice in the art to which the invention pertains, and as may be applied to the central features hereinbefore set forth, and fall within the scope of the invention of the limits of the appended claims.

I claim:

1. A carrier device for infants or other items which is adapted to be secured to a wearers upper body and comprising:

a. first and second rigid, inverted J-shaped member, each of said J-shaped members comprising a downwardly extending short leg portion and a downwardly extending long leg portion interconnected by a top portion which is positioned central over each shoulder of the wearer;

b. a cross-bar interconnection member including first and second ends, said cross-bar interconnection member extending between and connected to at said first and second ends to said first and second J-shaped member long leg portions to position said long leg portions parallel to each other, said J-shaped member long leg portions pivotally attached to said cross-bar interconnection member to allow about 90° inward axial rotation of said long leg portions to cause said short leg portions to swing into a folded position;

c. a generally U-shaped seat portion having a front, first side, second side, first end and second end, said seat portion first end pivotally connected to said first J-shaped member long leg portions and said seat portion second end pivotally to said second J-shaped member long leg portion to allow said seat portion to swing upwardly from a substantially horizontal position and against said long leg portions into a folded position;

d. first stop means on said cross-bar interconnection member to lock said seat portion into a less than 90° horizontal position from said long leg portions; and e. first closed webbing means secured to said long leg portions and extending therebetween to form a back rest and second closed webbing means secured to said U-shaped seat portion and said interconnection member and extending therebetween thereby providing a seat.

2. A carrier device as in claim 1 and further comprising:

a. separate shoulder strap means adjacent said top portion and secured to and extending between said first and second J-shaped member long leg portions and said seat portion front; and b. lap strap means secured to and extending between said first side and said second side of said seat portion.

3. A carrier devices as in claim 2 and further comprising:

a. said shoulder strap means and said lap strap means each provided with releasable interconnector means for securing an infant or other item to the carrier device.

4. A carrier device as in claim 1 and further comprising:

a. said first and said second rigid inverted J-shaped members provided with a foam rubber covering to cushion a user from the device.

5. A carrier device as in claim 1 and wherein:

a. said stop means comprising first abutments projecting from said ends of said first cross-bar interconnection member and below said first side and said second side of said generally U-shaped seat portion to contact and support said seat portion when in the horizontal position.

6. A carrier device as in claim 1 and further comprising:

a. first and second extension members, each of said extension members connected to and downwardly extending from one of said J-shaped members short leg portions and at a distance substantially equal to said J-shaped members long leg portion;

b. a second cross-bar interconnection member including first and second ends and extending between said first and second extension members to position said first and second extension members parallel to each other;

c. a second generally U-shaped seat portion having a front, first side, second side, first end and second end, said seat portion first end pivotally connected to said first extension member and said seat portion second end pivotally connected to said second extension member to allow said seat portion to swing upwardly from a substantially horizontal position and against said first and said second extension members and into a folded position;

d. second stop means on said second cross-bar interconnection member to lock said second seat portion into a less than 90° horizontal position from said first and second extension members; and e. third closed webbing means secured to said first and second extension members and extending therebetween to form a support surface and fourth closed webbing means secured to and extending between said second member and said second cross-bar interconnection member.

7. A carrier device as in claim 6 and further comprising:

a. said first and second extension members provided with a foam rubber covering to cushion a user from the device.

8. A carrier device as in claim 6 and wherein:

a. said stop means including at least one abutment projecting laterally from each of said ends of said second cross-bar interconnection member and below said first side and said second side of said U-shaped seat portion to provide support for said seat portion when in the horizontal position.

* * * * *